US005411621A

United States Patent [19]

Johenning

[11] Patent Number: 5,411,621

[45] Date of Patent: May 2, 1995

[54] WATERBED CORNER STRUCTURE AND METHOD

[75] Inventor: John B. Johenning, Beverly Hills, Calif.

[73] Assignee: Strata Flotation, Inc., Beverly Hills, Calif.

[21] Appl. No.: 470,163

[22] Filed: Jan. 25, 1990

Related U.S. Application Data

[62] Division of Ser. No. 395,715, Aug. 18, 1989, Pat. No. 4,930,172.

[51] Int. Cl.[6] ..... B29C 45/00

[52] U.S. Cl. ..... 156/242; 156/245; 5/448; 5/451; 5/474; 264/328.1

[58] Field of Search ..... 156/211, 242, 245; 264/328.1; 5/400, 451, 448, 456, 474, 495, 497

[56] References Cited

U.S. PATENT DOCUMENTS

| | | | |
|---|---|---|---|
| 3,957,557 | 5/1976 | Fraige | 5/451 |
| 4,251,308 | 2/1981 | Miller | 5/451 |
| 4,256,159 | 3/1981 | Williams | 428/79 |
| 4,734,946 | 4/1988 | Saputo | 5/400 |
| 4,833,744 | 5/1989 | Correa | 29/72.5 |
| 4,914,761 | 4/1990 | Boyd | 5/451 |

OTHER PUBLICATIONS

"The Naturalizer" a pamphlet of the Land and Sky Company of Lincoln, Nebraska, 1989.

"Freefloating Hydraulic System" an undated brochure of the Monterrey Co.

*Primary Examiner*—Caleb Weston

*Attorney, Agent, or Firm*—Flehr, Hohbach, Test, Albritton & Herbert

[57] ABSTRACT

Waterbed corner structure and method in which a cornerpiece is formed as a monolithic structure with a relatively thick base plate and relatively large ridges projecting from the front surface of the base plate. The base plate has a peripheral sealing area which is affixed by heat sealing to the walls of the mattress to form the corner, and the base plate is formed of a material which is pliant enough to conform to the contour of the mattress and tough enough to resist puncturing. The ridges help to keep bedsheets in place on the mattress.

1 Claim, 3 Drawing Sheets

WATERBED CORNER STRUCTURE AND METHOD

This is a division of Ser. No. 395,715, filed Aug. 18, 1989, now U.S. Pat. No. 4,930,172.

This invention pertains generally to waterbeds and, more particularly, to a structure and method for making the corner of a waterbed mattress.

In its simplest form, a waterbed mattress consists of two generally rectangular sheets of a material such as polyvinylchloride which are sealed together along their edges to form an enclosure. When this enclosure is filled with water, it assumes a three dimensional shape which has a depth as well as a length and a width. Because of the simple peripheral seam, the corners of a mattress made in this manner tend to be rounded rather than square.

Other waterbed mattresses have been made with contoured or fitted corners. In these mattresses, the enclosure is typically formed with a corner structure having a height corresponding to the depth of the mattress so that the mattress will have substantially square corners when it is filled with water.

One problem in waterbeds is leaks due to puncturing of the mattress, for example, by staples used to hold a liner in place or by screws or nails used to hold a frame together. The corners of a mattress are particularly vulnerable to this problem since that is where the majority of the metal fasteners and other sharp objects are generally found.

Heretofore, there have been some efforts to provide waterbed mattresses with corners which will resist puncturing. In one such approach, layers of vinyl film are laminated together to form a cornerpiece, and the laminated structure is attached to the walls of the mattress by heat sealing. Raised lettering and a peripheral bead are formed in the cornerpiece by recesses in the sealing die. The lettering and bead are relatively flat, and they are primarily decorative. Moreover, the thickness of the laminated structure is not uniform, and this makes it difficult to get a uniformly good heat seal between the cornerpiece and the mattress walls.

It is in general an object of the invention to provide a new and improved structure and method for making a waterbed corner.

Another object of the invention is to provide a structure and method of the above character which overcome the limitations and disadvantages of corner structures heretofore provided.

These and other objects are achieved in accordance with the invention by forming a cornerpiece for a waterbed mattress as a monolithic structure comprising a relatively thick base plate with relatively large cleats or ridges projecting from the front surface thereof. The base plate has a peripheral sealing area which is affixed by heat sealing to the walls of the mattress to form the corner, and the base plate is formed of a material which is pliant enough to conform to the contour of the mattress and tough enough to resist puncturing. The ridges help to keep bedsheets in place on the mattress.

Figure 1:
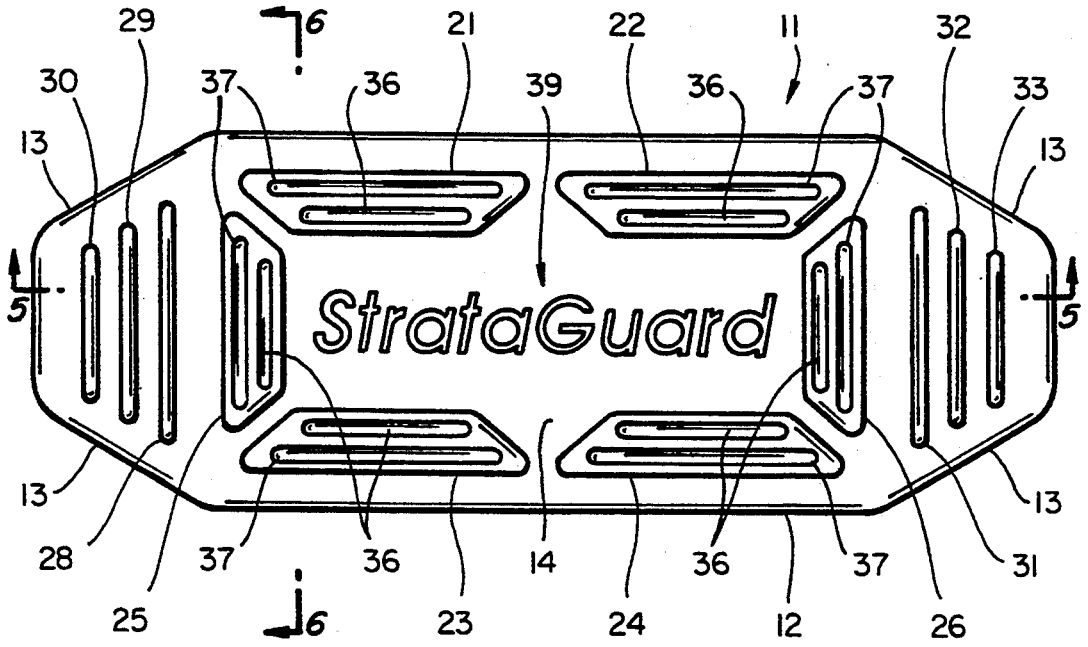
FIG. 1 is a front elevational view of one embodiment of a waterbed mattress cornerpiece according to the invention.
Figure 2:
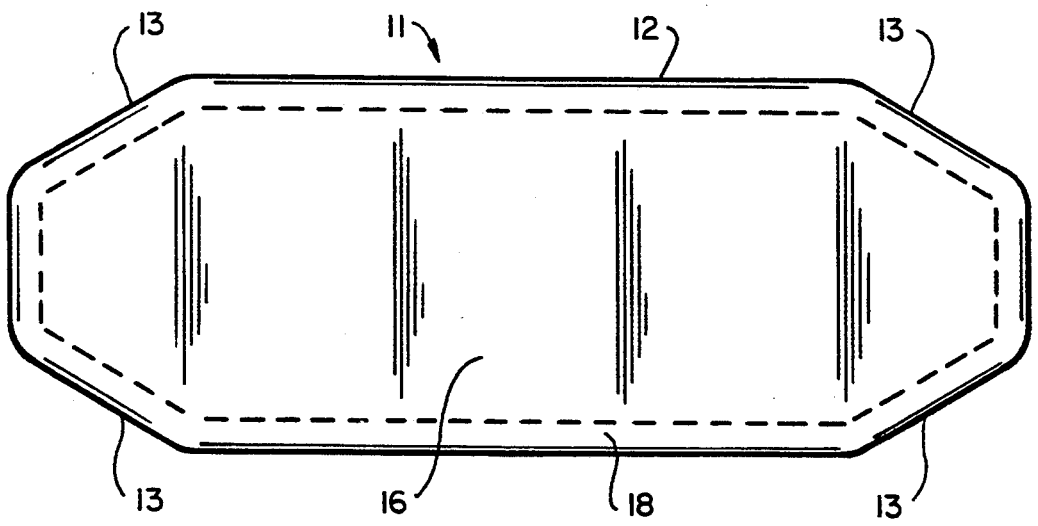
FIG. 2 is a rear elevational view of the embodiment of FIG. 1.
Figure 3:
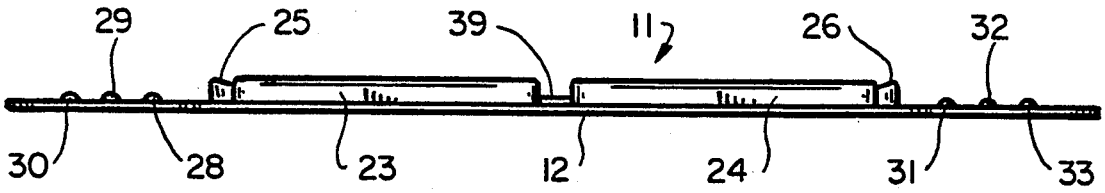
FIG. 3 is a side view of the embodiment of FIG. 1.
Figure 4:
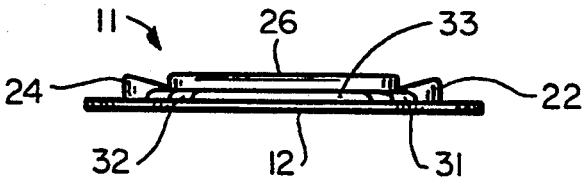
FIG. 4 is an end view of the embodiment of FIG. 1.
Figure 5:
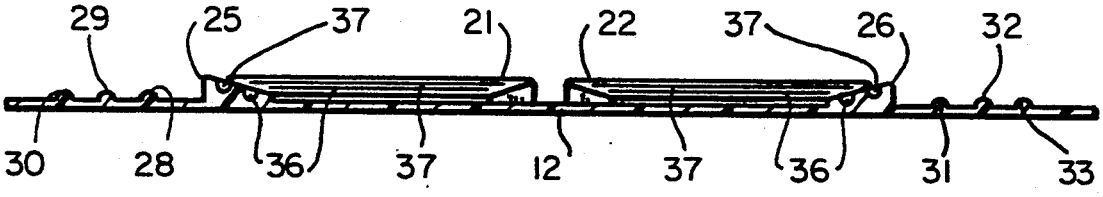
FIG. 5 is a cross-sectional view taken along line 5—5 in FIG. 1.
Figure 6:
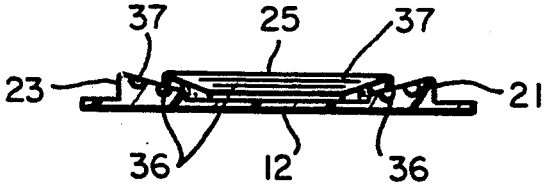
FIG. 6 is a cross-sectional view taken along line 6—6 in FIG. 1.

As illustrated in the drawings, the cornerpiece 11 has a generally rectangular base plate 12 with mitered corners 13. The base plate has front and rear surfaces 14, 16 which are generally flat or planar prior to installation, although the plate is fabricated of a pliant material which permits the cornerpiece to conform to the corner contour of the mattress in which it is installed. A peripheral sealing area 18 is provided on the back side of the base plate for attachment to the walls of a mattress to form the corner.

A plurality of relatively heavy ridges project from the front surface of the base plate. These ridges include elongated trapezoidal cleats 21–26 and raised beads 28–33. The cleats are arranged in a rectangular pattern, with cleats 21, 22 and 23, 24 extending longitudinally along opposite side margins of the base plate and cleats 25, 26 extending transversely between the outer ends of the longitudinally extending cleats. Beads 28–30 and 31–33 extend transversely of the tapered end portions of the base plate. Raised lettering 34 projects from the front surface of the base plate in the rectangular area bounded by the cleats.

The cleats have a generally triangular profile in cross section, and each of them has a pair of generally parallel grooves 36, 37 which extend longitudinally of the cleats. These grooves have a generally semicircular cross-sectional contour. The beads 28–33 decrease in length toward the ends of the base plate, and each of the beads has a semicircular profile in cross section.

The cleats, beads and raised lettering provide protection against punctures, as well as resistance to abrasion, and they also engage the bedsheets which are wrapped or tucked around the corners and thus help to retain the sheets in place on the mattress.

The base plate, cleats, beads and raised lettering are all formed as a monolithic structure by a suitable process such as injection molding. This process provides a rugged solid structure and is preferred to other processes such as vacuum forming or pressure forming which would produce an embossed effect with indentations in the rear surface behind the raised lettering and other protuberances on the front side of the base plate. The injection molding process also has the advantage of forming the peripheral The cornerpiece is preferably fabricated of a material which can be affixed to the walls of the mattress by heat sealing, is pliant enough to conform to the contour of the mattress and is tough enough to resist puncturing. The cornerpiece is generally fabricated of the same type of material as the rest of the mattress, and in a vinyl mattress, for example, the cornerpiece is fabricated of vinyl.

The cornerpiece has a heavy construction which provides good protection against puncturing and also provides a good grip on the bedsheets to help keep them in place, as well as being aesthetically pleasing. In one presently preferred embodiment, the corner piece has a length on the order of $8\frac{1}{2}$ inches, a width on the order of $3\frac{1}{4}$ inches and a thickness on the order of 0.050 inch, with cleats 21–26 projecting about 0.110 inch along their outer edges, beads 28–33 projecting about 0.050 inch, and lettering 39 projecting about 0.040 inch. While 0.050 inch is currently a preferred thickness for the base plate, the base plate can have a thickness on the order of 0.020 to 0.080 inch for a mattress having a walls of 20 mil vinyl.

Figure 7:
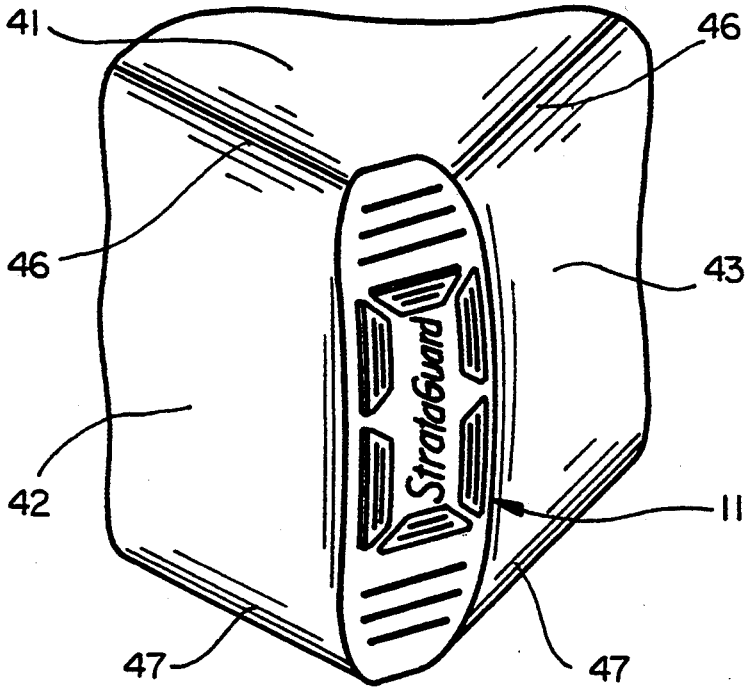
FIG. 7 is a fragmentary isometric view of a waterbed mattress with the cornerpiece of FIG. 1 installed therein.
Figure 8:
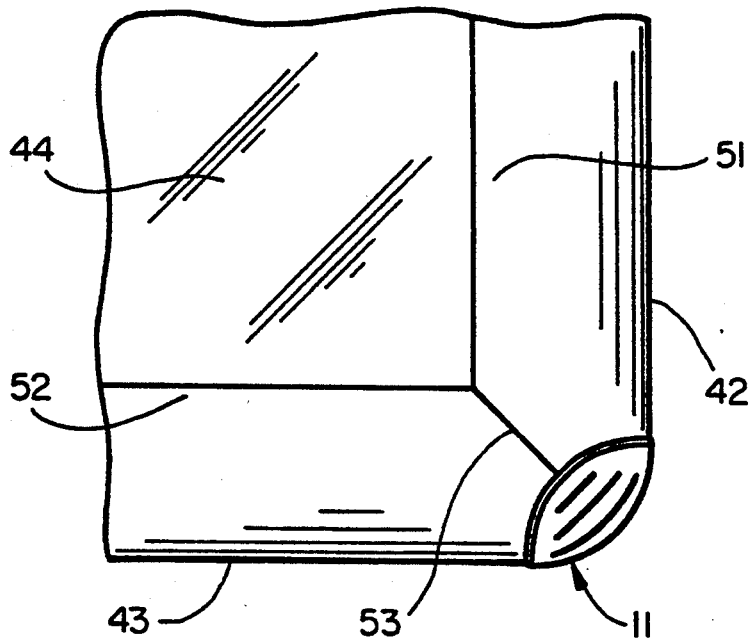
FIG. 8 is a fragmentary bottom plan view of the mattress of FIG. 7.

FIGS. 7–8 illustrate the cornerpiece 11 in connection with a mattress in which the top wall 41 and side walls 42, 43 are formed of a single sheet of material such as a 20 mil vinyl film, and the bottom wall 44 is formed of a separate sheet of a similar material. The sheet which forms top and side walls wraps around the upper and lower side edges 46, 47 and extends a short distance on the under side of the mattress where it is sealed to the rectangular sheet which forms the bottom wall. At the corner, the upper sheet is trimmed and heat sealed to the peripheral sealing area on the back side of the cornerpiece, and the portions 51, 52 of the sheet which extend on the under side of the mattress are sealed together along a diagonally extending line 53. The resulting corner structure is contoured or fitted, and the mattress has a generally square corner when filled with water, with the cornerpiece being gently curved in both horizontal and vertical directions.

Alternatively, if desired, the cornerpiece can be molded in the desired contour for the corner of the mattress, rather than being molded flat and formed into a three-dimensional contour by the water in the mattress and the frame of the bed. When the cornerpiece is molded with a three-dimensional contour, a three-dimensional die is required for sealing the cornerpiece to the walls of the mattress, but the resulting corner has a better contour than a corner having a flat cornerpiece.

The invention has a number of important features and advantages. The cornerpiece is heavy enough to provide good protection against punctures, and the cleats, beads and lettering which project from the outer surface help to the hold the bedsheets in place on the mattress, as well as providing abrasion resistance. Being injection molded and formed as a monolithic structure, the cornerpiece has a uniform thickness throughout its peripheral sealing area, and this helps to assure a good seal between the cornerpiece and the walls of the mattress.

It is apparent from the foregoing that a new and improved structure and method for making the corners of a waterbed mattress have been provided. While only certain presently preferred embodiments have been described in detail, as will be apparent to those familiar with the art, certain changes and modifications can be made without departing from the scope of the invention as defined by the following claims.

I claim:

1. In a method of making a corner in a waterbed mattress having walls of film material, the steps of: forming by injection molding a cornerpiece which is substantially thicker and tougher than the film material with cleats which project from a surface of the cornerpiece and are an integral part of the cornerpiece, and sealing the cornerpiece to the film material at a corner of the mattress.

* * * * *